US006487821B1

(12) United States Patent
Thomsen et al.

(10) Patent No.: US 6,487,821 B1
(45) Date of Patent: Dec. 3, 2002

(54) MOUNTING AND HINGE FITTING FOR A PANEL AND A PANEL SYSTEM COMPRISING SUCH FITTINGS

(75) Inventors: Morten Werner Thomsen, Roskilde (DK); Hans Ove Pedersen, Værløse (DK); Lars Helmersen, Jyllinge (DK); Vagn Einfeldt Jensen, Roskilde (DK); Aage Mathiassen Wind, Lynge (DK); Niels Birkedal Kristiansen, Copenhagen (DK)

(73) Assignee: VKR Holding A/S, Soborg (DK)

( * ) Notice: Subject to any disclaimer, the term of this patent is extended or adjusted under 35 U.S.C. 154(b) by 0 days.

(21) Appl. No.: 09/959,330

(22) PCT Filed: Apr. 18, 2000

(86) PCT No.: PCT/DK00/00200

§ 371 (c)(1),
(2), (4) Date: Feb. 14, 2002

(87) PCT Pub. No.: WO00/65171

PCT Pub. Date: Nov. 2, 2000

(30) Foreign Application Priority Data

Apr. 23, 1999 (DK) ..... 1999 00557

(51) Int. Cl.[7] ..... E04B 7/02

(52) U.S. Cl. ..... 52/90.1; 52/278; 52/277; 16/365; 16/355; 49/71

(58) Field of Search ..... 52/640, 645, 90.1, 52/91.1, 91.3, 72, 73, 74, 75

(56) References Cited

U.S. PATENT DOCUMENTS

| | | | | | |
|---|---|---|---|---|---|
| 2,642,018 | A | * | 6/1953 | Weeber | 16/365 |
| 2,685,851 | A | * | 8/1954 | Zachman | 52/278 |
| 3,911,633 | A | * | 10/1975 | Bamberger | 49/71 |
| 4,998,389 | A | | 3/1991 | Pritts | |
| 5,209,031 | A | | 5/1993 | Tavano | |
| 5,826,380 | A | * | 10/1998 | Wolfe | 52/277 |
| 6,119,410 | A | * | 9/2000 | Wolfe | 16/355 |

* cited by examiner

*Primary Examiner*—Carl D. Friedman
*Assistant Examiner*—Steve Varner
(74) *Attorney, Agent, or Firm*—Venable; John P. Shannon; Chad C. Anderson

(57) ABSTRACT

The panels (1, 2) are along a frame member connected to one or more support elements (3) in an angle of inclination in relation to a subjacent securing plane by means of mounting and hinge fittings (4) which can be adjusted in dependence of said angle of inclination, the fittings also constituting the hinge fittings of the openable panels. Each fitting (4) comprises a securing part for connection with the support element (3), a hinge part for connection with the frame structure of the panel (1, 2) and an adjustment part connecting the securing part with the hinge part.

22 Claims, 2 Drawing Sheets

Figure 1:
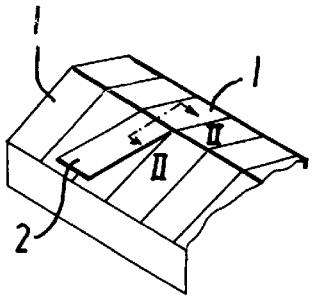

MOUNTING AND HINGE FITTING FOR A PANEL AND A PANEL SYSTEM COMPRISING SUCH FITTINGS

The present invention relates to a fitting for connection of a frame structure of a panel with a support element, said panel being mounted in an angle of inclination in relation to a subjacent securing plane, and said panel being openable or fixed, which fitting can be adjusted in dependence on said angle of inclination, and which comprises a securing part for connection with the support element and an adjustment part.

Such fittings are known in many different designs and in cases with fixed panels they are usually designed as support fittings with oblique sections defining the possible inclination of the panel. In openable panels, the connection is made by especially designed hinge fittings.

Fittings of this kind used in panels for construction of e.g. tilted surfaces must be produced in several various forms because of the structure of the known fittings, dependent on whether the panel is to be openable or fixed and on the inclination of the panel.

GB patent application No. 2 204 627 discloses a system of such panels which together form a glass roof. The support element in this publication is constituted by e.g. a ridge section of a continuous ridge profile with oblique side wall defining the inclination of the roof. In the openable panels, the side wall of the ridge profile are connected with separate hinge fittings.

Even though this arrangement provides a good and stable connection between the support element and the panels, the production has, however, the inconvenience that besides the special mounting and hinge fittings, particular ridge profiles must be made for each individual project in dependence of varying desires as to the angle of inclination of the profiles.

In order to remedy said inconveniences, U.S. Pat. No. 4,998,389 has e.g. proposed a mounting fitting permitting to adjust the angle of inclination of fixed panels, whereas FR patent application No. 2 727 165 suggests a fitting of a similar kind where the angle of inclination can be adjusted stepwise in few predetermined positions.

Therefore, the object of the invention is to provide a fitting of the kind stated in the introduction where standardization of the production becomes more feasible and where in a simple manner, increased flexibility when mounting the panels is obtained, including in particular the option to choose the angle of inclination suitable for the installation conditions.

This purpose is achieved in that said fitting is designed as a mounting and hinge fitting constituting also the hinge fitting of an openable panel, and in that each fitting comprises a hinge part for connection with the frame structure of the panel, said adjustment part connecting the securing part with the hinge part.

By this invention, the desired standardization and flexibility are obtained, as the tripartite integrated mounting and hinge fitting comprises partly a hinge part and thus can be used both for fixed and openable panels, partly an adjustment part which permits a preparation of the panel for the wanted inclination.

In another aspect, a panel system for construction of one or more panel fillets or a major panel surface, such as a glass roof, comprising a number of fixed panels and at least one openable panel, each panel comprising a frame structure bordering a panelling element, each panel in at least one panel fillet along a frame member being meant for connection with one or more support elements extending along at least one part of said fillet, the panels in said fillets being mounted in an angle of inclination in relation to a subjacent securing plane by means of at least one fitting which can be adjusted in dependence of said angle of inclination and which each comprises a securing part for connection with the support element and an adjustment part, and each openable panel in said fillet being connected with said support element or support elements by means of hinge fittings. The panel system is characterized in that the panels in said fillets are connected with said support element or support elements by means of mounting and hinge fittings constituting also the hinge fittings of the openable panels, and in that each fitting comprises a hinge part for connection with the frame structure of the panel, said adjustment part connecting the securing part with the hinge part.

By adjusting the angle of inclination of the panels by means of a separate mounting and hinge fitting, the support element can be produced as a standard product, and the adjustment of the fitting according to the desired inclination can be effected at any time, e.g. on the building site where the final mounting takes place. As the fittings further serve as hinge fittings of the openable panels, an additional standardization is obtained, as all panels can then be improved for opening and not until a relatively late stage during the project is it necessary to decide whether the individual panel is to be openable or fixed. The mounting and hinge fitting according to the invention can be used for many different geometrical compositions or constructions, e.g. light bands, ridges, double pitch skylights, single pitch skylights and pyramids.

The adjustment part comprises preferably an essentially plate-shaped element with the form as a section of a circular ring arranged in a plane which is essentially perpendicular to the longitudinal direction of the support element and essentially parallel to the side frame members of the panel. In this design, the abutment of the frame on sealant strips in a main frame or a subjacent roof structure will be constant, both as to contact point and gasket pressure.

For adjustment of the mounting and hinge fitting, the securing part may have a slot perpendicular to the plane of the annular ring and for reception hereof, as the adjustment part upon insertion of the annular ring in the slot is secured in the desired position in relation to the securing part by e.g. welding.

Alternatively, the adjustment part can be provided with a slot shaped as a circular arc for engagement with a pin on the hinge part.

Further features of the invention will appear from the remaining dependent claims.

Figure 3:
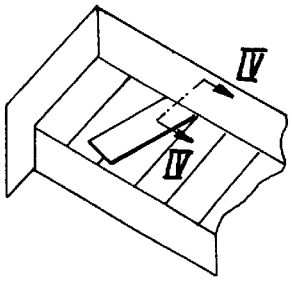
Figure 4:
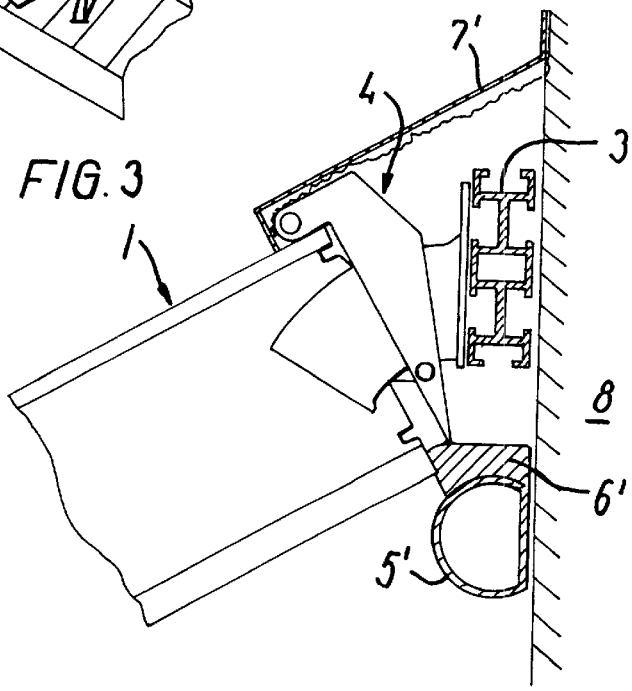

In the following, the invention will be explained in more detail with reference to the schematic drawing where FIG. 1 shows a perspective view of a section of a panel system according to the invention, FIG. 2 a sectional view along the line II-II in FIG. 1, FIG. 3 a view corresponding to FIG. 1, but with another positioning of the top fillet of the panel system, FIG. 4 a sectional view along the line IV—IV in FIG. 2, FIG. 5 a perspective view of a detail of the panels system according to the invention, FIG. 6 a view according to FIG. 4, showing an alternative embodiment of the panel system, FIG. 7 a sectional view of a detail of the panel system, and FIG. 8 a side view of a detail of the panel system.

The panel system shown in FIG. 1 comprises two panel fillets which in the shown embodiment together form a glass roof. The panel system comprises a number of fixed panels 1 together with one or more openable panels 2. Each panel is in a manner known per se constructed of a frame structure with four frame members which together border a panelling element, e.g. an insulating pane or an opaque plate element. As mentioned in the above, the panels can be used for many different geometrical constructions and thus have another shape than the shown rectangle, e.g. a triangular or another polygonal shape.

Figure 2:
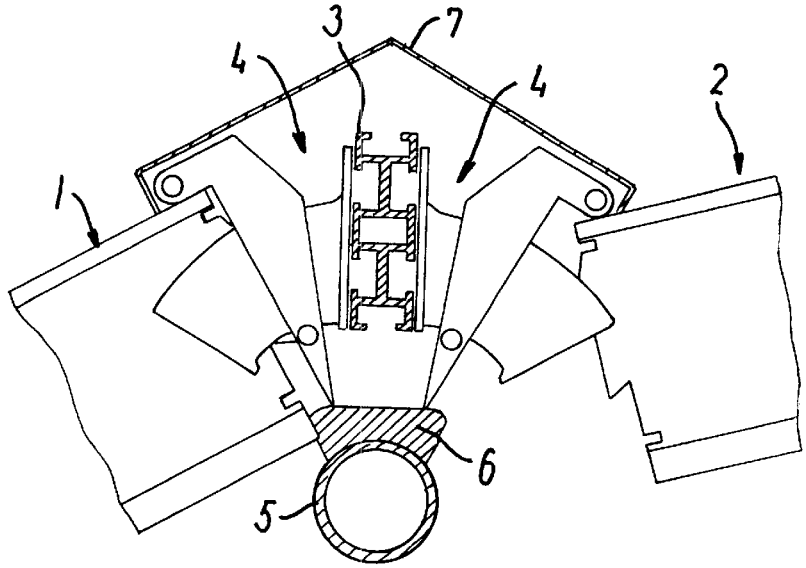

As appears from FIG. 2, each panel 1, 2 is at a top panel edge, i.e. a top frame member, connected to a support element 3 by means of a mounting and hinge fitting generally designed 4, the support element 3 extending over essentially the entire length of the two rows of panels 1, 2. A design with a multitude of shorter support elements is obviously also conceivable.

The support element 3 is designed as e.g. an extruded profile element and constitutes a ridge profile of the panel system. At its bottom edge, the support element 3 is, in a manner not shown in detail via individual connecting pieces placed at a distance and also serving as cold breakers, connected to a tube bar 5 extending in parallel with the support element 3 and which furthermore serves as a support for a gasket 6. An exterior flashing 7 is arranged above the support element 3 and encapsulates thus the mounting and hinge fittings 4 and a top part of the panels 1, 2.

The support element 3 is designed as a standard profile and can, as appears from FIGS. 3 and 4, also be used for a panel fillet which at a top edge is connected to a supporting structure element 7 which e.g. can be a wall or a transverse beam. The support element 3 is in the same or a corresponding way as described in connection with FIG. 2 connected to a profile 5' carrying a sealant strip 6' and is covered by a flashing 7'.

The determination of the angle of inclination in relation to a subjacent securing plane of the panels 1, 2 will in the following be explained with reference to FIGS. 5-8 where the construction of the mounting and hinge fittings 104, 204 and 304 is shown, the construction in principle of these fittings being identical and corresponding to the mounting and hinge fitting 4 shown in FIGS. 1–4.

Figure 5:
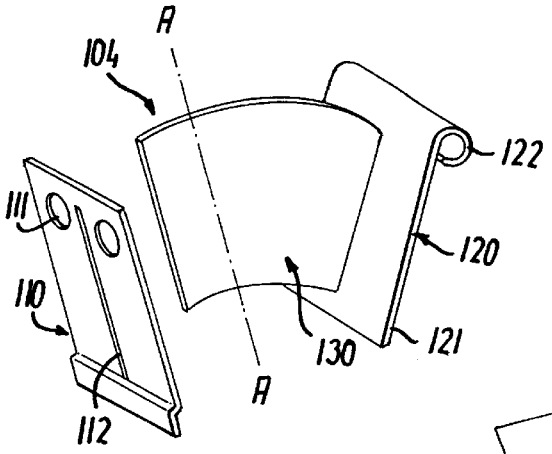

Thus, the fitting 104 shown in FIG. 5 comprises a securing part 110 designed as an essentially plate-shaped element and provided with two apertures 111 for reception of screws, bolts or alike for connection with the support element. Other forms of engagement means are of course also conceivable.

Furthermore, the fitting 104 comprises a hinge part 120 comprising a base plate section 121 for connection with the frame structure of the panel and a hinge section 122. The hinge section 122 is designed as a bush mounting meant for reception of a hinge pin in connection with the frame structure, whereby the hinge pin defines a hinge axis essentially parallel with a top frame member and thus the support element.

An adjustment part 130 designed as an essentially plate-shaped element with the form of section of a circular ring is connected to the base plate section 121 of the hinge part 120. The circular ring is placed in a plane essentially perpendicular to base plate section of the hinge part 120 and thus perpendicular to the top frame member and the support element.

The circular ring section of the adjustment part 130 is inserted in the slot 112 in the securing part 110 to a desired position, e.g. as illustrated by the line A—A, and fixed in this position by e.g. welding. The area placed on the side of the securing part 110 facing away from the hinge part 120 can subsequently be cut or clipped out.

It is to be understood that basically, the adjustment part 130 might as well be fixedly connected to the securing part 110 and the angle of inclination is adjusted by means of a slot provided in the hinge part 120. Alternatively, both the securing part 110 and the hinge part 120 can be provided with a slot.

Figure 6:
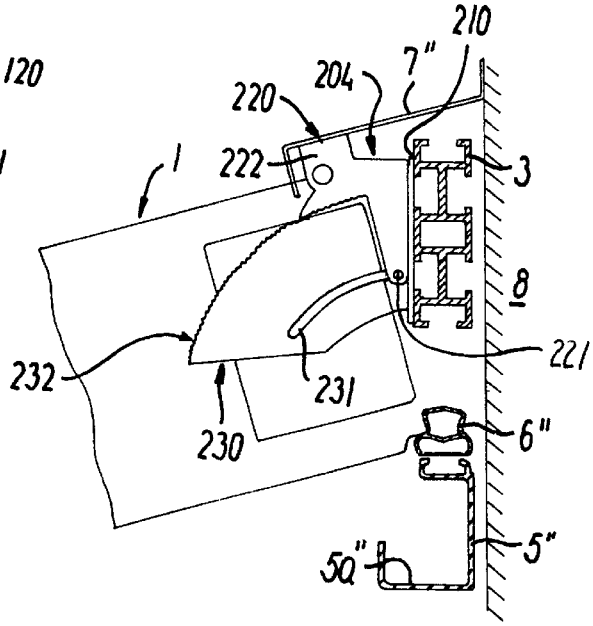

In the embodiment shown in FIG. 6, the angle of inclination is adjusted by guiding a pin on the hinge part 220 to an appropriate position in a circular arc-shaped slot 231 provided in the adjustment part 230. From this figure, it further appears that the adjustment part 230 along its exterior periphery with a view to improved engagement with the hinge part 220, in particular during the mounting phase where a temporary securement is desired, is provided with means to increase the surface friction, e.g. in the form of a knurling or as shown a slight toothing 232.

Furthermore, it appears from FIG. 6 how the support element 3 is connected to an alternative embodiment, of the profile element 5" which besides serving as a support for the gasket 6" also has an integrated water drain 5*a*".

Figure 7:
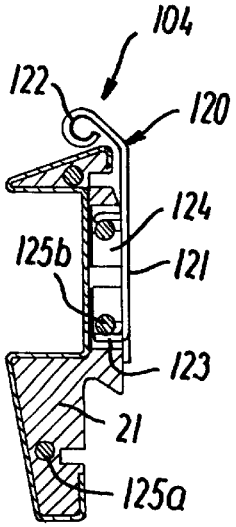

FIG. 7 shows how the fitting. 104 is connected with a top frame member 21 of e.g. an openable panel 2 by means of fittings 123, 124. The numbers 125*a*, 125*b* indicate corner angles used for joining the top frame member 21 and an adjacent side frame member. Since the corner angles 125*b* in connection with the hinge part 120 is connected with the side frame member, the securing forces originating from the structure will be led from top frame member and further down in the side frame member, which is advantageous as in many cases, it is avoided that the top member is exposed to a twist load.

Figure 8:
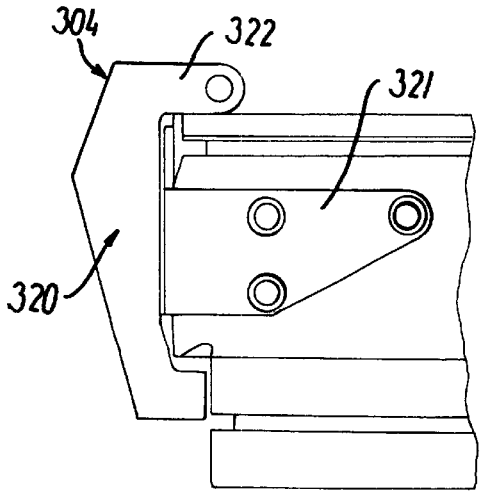

FIG. 8 shows an alternative embodiment of the mounting and hinge fitting 304 where the base plate section 321 of the hinge part 320 is designed as an angle brace. Besides providing a stable transfer of the securement forces to the side frame member, this design has the further advantage that the base plate section 321 can be used as gussets for all corners of the frame structure, i.e. also at the joint between the side frame member and bottom frame member.

The invention is not limited to the above embodiments. E.g. the mounting and hinge fitting can be used in connection with other forms of elements than panels, e.g. roof or facade windows. Furthermore, the hinge connection can be arranged at the bottom member of the frame structure or one of its side members.

What is claimed is:

1. A fitting (4, 104, 204, 304) for connection of a frame structure of a panel (1, 2) with a support element (3), said panel being mounted in an angle of inclination in relation to a subjacent securing plane, and said panel being openable or fixed, which fitting can be adjusted in dependence on said angle of inclination, and which comprises a securing part (110, 210, 310) for connection with the support element (3) and an adjustment part (130, 230), characterized in that said fitting is designed as a mounting and hinge fitting constituting also the hinge fitting of an openable panel, and in that each fitting (4, 104, 204, 304) comprises a hinge part (120, 220, 320) for connection with the frame structure of the panel (1, 2), said adjustment part (130, 230) connecting the securing part with the hinge part.

2. A mounting and hinge fitting according to claim 1, characterized in that the securing part (110, 210, 310) is designed as an essentially plate-shaped element with engagement means (111) for connection with the support element (3).

3. A mounting and hinge fitting according to claim 1, characterized in that the adjustment part (130, 230) comprises an essentially plate-shaped element with the form as a section of a circular ring.

4. A mounting and hinge fitting according to 30 claim 3, characterizedin that the adjustment part (230) along its exterior and/or internal periphery is provided with means to increase the surface friction, such as a slight toothing (232).

5. A mounting and hinge fitting according to claim 3, characterized in that the adjustment part (230) is provided with a circular arc-shaped slot (231) with essentially the same centre as said circular ring section.

6. A mounting and hinge fitting according to claim 1, characterized in that the hinge part (120, 220, 320) comprises a base plate section (121, 321) for connection with the frame structure.

7. A mounting and hinge fitting according to claim 6, characterizedin that the base 10 plate section (321) is designed as an angle brace for connection with two adjacent frame members.

8. A mounting and hinge fitting according to claim 6, characterized in that the hinge part (120, 220, 320) comprises a hinge section (122, 222, 322) in connection with the base plate section, and that the hinge section comprises a bush mounting which in a mounted position extends essentially parallel to an adjacent frame member and is meant for reception of a hinge pin in connection with the frame structure, whereby the hinge pin defines a hinge axis of the panel.

9. A mounting and hinge fitting according to claim 8, characterizedin that said hinge axis in a mounted position is placed at a distance in the direction of inclination from an edge of the panel.

10. A mounting and hinge fitting according to claim 3, characterized in that said securing part (110) has a slot (112) perpendicular to the plane of the annular ring and for reception hereof.

11. A mounting and hinge fitting according to claim 5, characterized in that the hinge part (220) comprises a pin perpendicular to the plane of the circular ring for engagement with said slot (231) in the adjustment part.

12. A panel system for construction of one or more panel fillets or a major panel surface, such as a glass roof, comprising a number of fixed panels (1) and at least one openable panel (2), each panel comprising a frame structure bordering a panelling element, each panel (1, 2) in at least one panel fillet along a frame member being meant for connection with one or more support elements (3) extending along at least one part of said fillet, the panels in said fillets being mounted in an angle of inclination in relation to a subjacent securing plane by means of at least one fitting which can be adjusted in dependence of said angle of inclination and which each comprises a securing part (110, 210, 310) for connection with the support element (3) and an adjustment part (130, 230), and each openable panel in said fillet being connected with said support element or support elements by means of hinge fittings, characterized in that the panels (1, 2) in said fillets are connected with said support element or support elements (3) by means of mounting and hinge fittings (4, 104, 204, 304) constituting also the hinge fittings of the openable panels, and in that each fitting (4, 104, 204, 304) comprises a hinge part (120, 220, 320) for connection with the frame structure of the panel (1, 2), said adjustment part (130, 230) connecting the securing part with the hinge part.

13. A panel system according to claim 12, characterized in that the securing part (110, 210, 310) is designed as an essentially plate-shaped element with engagement means (11) for connection with the support element (3).

14. A panel system according to claim 12, characterized in that the adjustment part (130, 230) comprises an essentially plate-shaped element with the form as a section of a circular ring arranged in a plane which is essentially perpendicular to the longitudinal direction of the support element and essentially parallel to the side frame members of the panel.

15. A panel system according to claim 14, characterizedin that the adjustment part (230) along its exterior and/or internal periphery is provided with means to increase the surface friction, such as a slight toothing (232).

16. A panel system according to claim 14, characterized in that the adjustment part (230) is provided with a circular arc-shaped slot (231) with essentially the same centre as said circular ring section.

17. A panel system according to claim 12, characterized in that the hinge part (120, 220, 320) comprises a base plate section (121, 321) for connection with the frame structure.

18. A panel system according to claim 17, characterizedin that the base plate section (321) is designed as an angle brace for connection with to adjacent frame members.

19. A panel system according to claim 17, characterized in that the hinge part (120, 220, 320) comprises a hinge section (122, 222, 322) in connection with the base plate section, and that the hinge section comprises a bush mounting which extends essentially parallel to an adjacent frame member and is meant for reception of a hinge pin in connection with the frame structure, whereby the hinge pin defines a hinge axis of the panel.

20. A panel system according to claim 19, characterizedin that said hinge axis is placed at a distance in the direction of inclination from an edge of the panel.

21. A panel system according to claim 14, characterized in that said securing part (110) has a slot (112) perpendicular to the plane of the annular ring and for reception hereof.

22. A panel system according to claim 16, characterized in that the hinge part (220) comprises a pin perpendicular to plane of circular ring for engagement with said slot (231) in the adjustment part.

* * * * *